United States Patent [19]

Doty

[11] Patent Number: 5,038,846

[45] Date of Patent: Aug. 13, 1991

[54] DIFFERENTIAL PRESSURE, COUNTERGRAVITY CASTING WITH ALLOYANT REACTION CHAMBER

[75] Inventor: Herbert W. Doty, Saginaw, Mich.

[73] Assignee: General Motors Corporation, Detroit, Mich.

[21] Appl. No.: 485,587

[22] Filed: Feb. 27, 1990

[51] Int. Cl.[5] ..... B22D 18/06; B22D 27/00

[52] U.S. Cl. ..... 164/58.1; 164/63; 164/255

[58] Field of Search ..... 164/55.1, 56.1, 57.1, 164/58.1, 59.1, 119, 63, 255, 306

[56] References Cited

U.S. PATENT DOCUMENTS

| | | | |
|---|---|---|---|
| 3,414,250 | 12/1968 | Snow | 266/34 |
| 3,488,756 | 3/1976 | Nieman | 164/57.1 |
| 3,703,922 | 11/1972 | Dunks et al. | 164/57.1 |
| 3,746,078 | 7/1973 | Moore et al. | 164/363 |
| 3,765,876 | 1/1973 | Moore | 75/130 |
| 3,819,365 | 6/1974 | McCauley | 75/130 |
| 3,870,512 | 3/1975 | Lee | 75/130 |
| 3,900,064 | 8/1975 | Chandley et al. | 164/51 |
| 3,961,663 | 6/1976 | Ulegois et al. | 164/58 |
| 3,971,433 | 7/1976 | Duchenne | 164/362 |
| 4,004,630 | 1/1977 | Dunks | 164/57.1 |
| 4,037,643 | 7/1977 | Mohia et al. | 164/58.1 |
| 4,040,821 | 8/1977 | Hetke et al. | 75/134 |
| 4,125,144 | 11/1978 | Kawamoto et al. | 164/4.1 |
| 4,210,195 | 7/1980 | McPherson | 164/57.1 |
| 4,312,688 | 1/1982 | Mannion et al. | 75/130 |
| 4,330,024 | 5/1982 | Wallace | 164/56.1 |
| 4,337,816 | 7/1982 | Kaku | 164/58.1 |
| 4,340,108 | 7/1982 | Chandley et al. | 164/63 |
| 4,606,396 | 8/1986 | Chandley et al. | 164/255 |
| 4,638,846 | 1/1987 | Ackerman et al. | 164/55.1 |
| 4,865,113 | 9/1989 | Voss et al. | 164/63 |

FOREIGN PATENT DOCUMENTS

| | | |
|---|---|---|
| 56-111551 | 9/1981 | Japan . |
| 59-150654 | 8/1984 | Japan . |
| 60-196259 | 10/1985 | Japan . |

*Primary Examiner*—Kuang Y. Lin

*Attorney, Agent, or Firm*—Reising, Ethington, Barnard, Perry & Milton

[57] ABSTRACT

A casting mold (e.g., a cope and drag) is disposed on a drag slab having a sprue and a reaction chamber containing an alloyant to be selectively introduced into the melt as it is drawn through the reaction chamber during differential pressure, countergravity casting. A rubber formed between the mold and the drag slab communicates the reaction chamber to a plurality of narrow mold ingates that supply the melt treated (alloyed) in the reaction chamber to the mold cavity during countergravity casting.

15 Claims, 2 Drawing Sheets

DIFFERENTIAL PRESSURE, COUNTERGRAVITY CASTING WITH ALLOYANT REACTION CHAMBER

FIELD OF THE INVENTION

This invention relates to an improved apparatus and method for the differential pressure, countergravity casting of a melt in such a manner as to pass the melt through a reaction chamber to selectively introduce alloyant into the melt as it is countergravity cast into the mold.

BACKGROUND OF THE INVENTION

A vacuum countergravity casting process using a gas permeable mold sealingly received in a vacuum housing is described in such patents as the Chandley et al U.S. Pat. Nos. 3,900,064; 4,340,108 and 4,606,396. That countergravity process involves providing a mold having a porous, gas permeable upper mold member (cope) and a lower mold member (drag) sealingly engaged at a parting plane, sealing the mouth of a vacuum housing to a surface of the mold such that a vacuum chamber formed in the housing confronts the gas permeable upper mold member, submerging the underside of the lower mold member in an underlying melt and evacuating the vacuum chamber to draw the melt upwardly through one or more narrow ingates (pin gates) in the lower mold member and into one or more mold cavities formed between the upper and lower mold members.

In practicing the vacuum countergravity process to produce nodular iron castings, the melt is typically prepared in a melting vessel (e.g., a cupola) using a charge of pig iron to which additions of alloyants are made to provide the desired base melt chemistry. For example, in casting nodular iron, ferromanganese (Fe—Mn), ferrosilicon (Fe—Si) and other additions are made to the base pig iron charge to provide a desired base melt chemistry.

Once the desired base melt composition is achieved, the melt is transferred from the melting vessel to a ladle where a nodularizing agent (e.g., a magnesium bearing alloy such as Fe—Si—Mg) is added to spherodize (nodularize) the carbon. The treated base melt is then transferred from the ladle to a casting vessel to provide a melt pool from which a plurality of molds are successively vacuum countergravity cast over time.

However, prior art workers have experienced great difficulty in maintaining an effective concentration (i.e., at least 0.02 percent by weight) of magnesium in the melt over the extended time required to cast a plurality of molds in succession from the melt. This difficulty is attributable to the rapid evaporation of magnesium from the melt after the initial treatment with the nodularizing agent in the transfer ladle. Erratic, uncontrolled loss (also known as fade) of the fugitive magnesium from the melt over time has been experienced and resulted in off-chemistry melts in so far as magnesium content is concerned and correspondingly inconsistent nodularization.

As a result of this inability to reliably control and maintain the melt chemistry (i.e., to maintain the magnesium content above the desired effective level) over the time required for casting a plurality of molds in succession, use of the countergravity casting processes described in the aforesaid patents in high volume production of nodular iron parts has been rendered impractical and/or uneconomical to date.

Moreover, in order to produce iron castings having different compositions/microstructures (e.g., corresponding to the known ferritic nodular grade 4010 or pearlitic nodular grade 5203), the practice has been to prepare separate base melts of the desired different compositions using pig iron charges to which appropriate alloy additives are made in the melting vessel and then ladling and countergravity casting the separate base melts from the casting vessel as described above. This practice amounts to producing castings of one composition/microstructure in one batch and castings of another different composition/microstructure in a separate batch with preparation as well as subsequent handling, treatment and casting of different base melts for each batch.

It is an object of the present invention to provide an improved apparatus and method for the differential pressure, countergravity casting of a melt wherein the melt is drawn through a reaction chamber formed in a drag slab to introduce alloyant therein above a predetermined effective concentration and the treated (alloyed) melt is then supplied to a casting mold, such as a cope and drag, disposed atop the drag slab.

It is another object of the invention to provide an improved apparatus and method for the differential pressure, countergravity casting of a melt wherein a fugitive alloyant, such as a Mg nodularizing agent used to nodularize iron, is introduced into the melt in a reaction chamber of a drag slab disposed between the mold and the melt to maintain a predetermined effective concentration of the fugitive alloyant in the melt supplied to the casting mold, thereby counteracting any previous loss (or fade) over time of the fugitive alloyant from the melt.

It is another object of the invention to provide an improved apparatus and method for the differential pressure, countergravity casting of a melt wherein the melt is treated (alloyed) in a reaction chamber in a drag slab disposed between the mold and the melt and supplied to the mold to produce a casting having a composition/micro- structure different from that obtainable from the underlying melt and tailored for a particular intended use, thereby eliminating the need to prepare, handle, treat and cast separate base melts.

SUMMARY OF THE INVENTION

The present invention contemplates an improved apparatus and method for the differential pressure, countergravity casting of a melt wherein a casting mold (e.g., a gas permeable cope and a drag) is disposed on an underlying drag slab having a sprue with a lower inlet adapted for engaging an underlying source of melt, and an alloyant-containing reaction chamber between upper and lower sides of the drag slab for receiving melt from the sprue. The casting mold includes a mold cavity and one or more ingates (e.g., pin gates) on the mold underside. The mold ingates are communicated directly or indirectly (e.g., via runners) to the reaction chamber for supplying the treated melt from the reaction chamber to the mold cavity during casting.

A sufficient differential pressure is established between the mold cavity and the underlying source of melt when the sprue inlet and the source are engaged to draw the melt upwardly through the sprue into the reaction chamber where the melt so contacts the alloyant as to have the alloyant introduced therein. The treated (alloyed) melt then is drawn through the mold ingates to fill the mold cavity with the treated melt.

In one embodiment of the invention, a lateral runner system is formed in the underside of the casting mold (e.g., in the underside of the mold drag) and communicates the narrow ingates (e.g., pin gates) formed in the mold drag to the reaction chamber in the drag slab.

In another embodiment of the invention for countergravity casting of nodular iron, the reaction chamber in the drag slab contains a fugitive magnesium-bearing nodularizing agent contacted by the melt drawn through the reaction chamber during countergravity casting so as to introduce the nodularizing agent into the melt immediately prior to its entering the mold cavity. The concentration of the fugitive nodularizing agent in the melt entering the mold cavity is maintained above a predetermined effective concentration for nodularizing the carbon in the melt. This alleviates problems of loss (or fade) over time of the nodularizing agent from the melt.

In another embodiment of the invention, an alloyant is introduced into the melt in the reaction chamber in the drag slab for supply to the mold to form a casting having a composition/microstructure tailored to a particular end use and different from that obtainable by solidification of the underlying melt. For example, copper can be introduced into a ferritic nodular iron melt as it is drawn through the reaction chamber prior to entering the mold cavity to produce a casting having a microstructure and mechanical properties (e.g., tensile and yield strength) corresponding to a pearlitic nodular iron grade.

The aforementioned objects and advantages of the present invention set forth hereinabove will become more readily apparent from the detailed description and drawings which follow.

DETAILED DESCRIPTION OF SPECIFIC EMBODIMENTS

Figure 1:
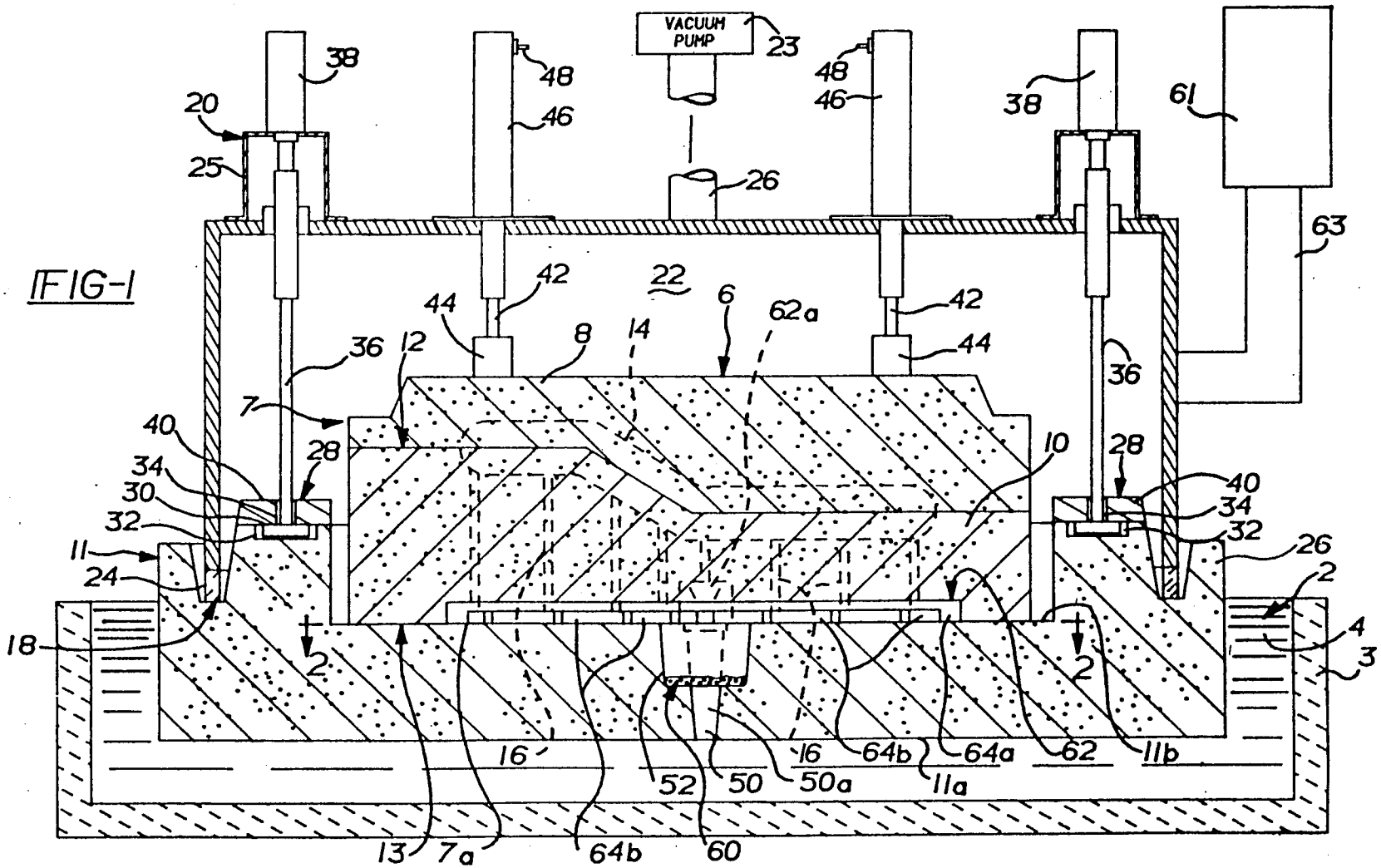
FIG. 1 is a sectioned, side view of a vacuum countergravity casting apparatus in accordance with the invention.

FIG. 1 depicts a pool 2 of melt 4 which is to be drawn up into a casting mold assembly 6 comprising a gas-permeable casting mold 7 disposed on a lower drag slab 11 at a parting line 13. The casting mold 7 includes a gas permeable upper mold portion 8 (mold cope) and a lower mold portion 10 (mold drag) engaged at a parting line 12 and defining a mold cavity 14 therebetween. The melt 4 is contained in an underlying casting furnace or vessel 3 heated by one or more induction coils (not shown) to maintain the melt 4 at a desired casting temperature.

The drag slab 11 is sealed to the mouth 18 of a vacuum box 20 defining a vacuum chamber 22 via a seal 24 (e.g., high temperature rubber, ceramic rope, etc.). The seal 24 is affixed to the lower edge of the depending peripheral side 25 of the vacuum box 20 to this end. The vacuum chamber 22 encompasses the upper mold portion 8 and communicates with a vacuum source 23 (e.g., a vacuum pump) via conduit 26.

The seal 24 on the peripheral wall 25 of the vacuum box 20 may engage the upper mold portion 8 or the lower mold portion 10 in lieu of engaging the drag slab 11. In situations where the seal 24 engages the upper or lower mold portion 8,10, the exterior surfaces of the mold 7 and/or drag slab 11 exposed outside the vacuum box 20 may be substantially sealed as by coating with a core wash material (e.g., a silica slurry) well known in the art to reduce the gas permeability of those surfaces and provide better control of the negative differential pressure established between the inside and the outside of the vacuum box 20. Moreover, if exposed outside the vacuum box 20, one or both of the parting lines 12,13 may be glued to this same end; i.e., to reduce or prevent drawing of air into the mold assembly 6 at the parting lines 12,13.

The upper mold portion 8 comprises a gas-permeable material (e.g., resin-bonded sand) which permits gases to be withdrawn therethrough from the mold cavity 14 when a vacuum is drawn in the vacuum chamber 22. The lower mold portion 10 and the drag slab 11 may conveniently comprise the same material as the upper mold portion 8 or other materials, permeable or impermeable, which are compatible with the material of the upper mold portion 8. The drag slab 11 includes an upstanding levee 26 surrounding the seal 24 and isolating it from the melt 4 for purposes described in U.S. Pat. No. 4,745,962 and assigned to the assignee of the present invention. The upper and lower mold portions 8,10 and the drag slab 11 are each made in accordance with known mold practice where a compliant (shapeable) mixture of sand or equivalent particles and a settable binder material (e.g., an inorganic or organic thermal or chemical setting plastic resin) is formed to shape and then cured or hardened against respective contoured pattern plates (not shown). Alternately, the drag slab 11 could be made of a different material resistant to degradation in the melt to enable repeated use in casting multiple disposable molds in succession.

The drag slab 11 includes a plurality of anchoring sites 28 engaged by T-bar keepers 30 of the type described in commonly assigned U.S. patent application Ser. No. 147,863, abandoned in favor of patent application Ser. No. 286,051, providing means for mounting a mold assembly to the vacuum box 20. In particular, the drag slab 11 is provided with a plurality of anchoring cavities 32 adapted to receive the T-bar keepers 30 via slots 34 in the shelves 40 overlying the anchoring cavities 32 and attached to the drag slab 11. A 90° rotation of the T-bar carrying shafts 36 (e.g., by air motors 38) causes the T-bar keepers 30 to engage the underside of the attached shelves 40 overhanging the cavities 32 to secure the drag slab 11 to the vacuum box 20. Other known mold assembly-to-vacuum box mounting means can also be employed in practicing the invention (e.g., see U.S. Pat. No. 4,658,880).

The upper mold portion 8, the lower mold portion 10 and the drag slab 11 are pressed into sealing engagement (i.e., at the parting lines 12 and 13) by means of a plurality of plungers 42 so as to eliminate, if desired, the need to glue the upper and lower mold portions 8,10 at the parting line 12 and lower mold portion 10 and drag slab 11 at the parting line 13. Feet 44 on the ends of the plungers 42 distribute the force of the plungers 42 more widely across the top of the upper mold portion 8 to prevent penetration/puncture thereof by the ends of the plungers 42. Pneumatic springs 46 bias the plungers 42 downwardly to resiliently press the upper mold portion 8 against the lower mold portion 10 and the lower mold portion 10 against the drag slab 11 as the mold assembly 6 is being positioned in the mouth 18 of the vacuum box 22. Schrader valves 48 on the air springs 46 permit varying the pressure in the springs 46 as needed to apply sufficient force to press the upper mold portion 8, the lower mold portion 10 and the drag slab 11 into sealing engagement, and, as needed, to prevent destructive inward flexure of the mold assembly 6 when the casting vacuum is drawn. The force applied by the plungers 42, however, will not be so great as to overpower and damage the anchoring sites 28, dislodge the mold assembly 6 from the mouth 18 of the box 20, or break the seal formed thereat.

Figure 2:
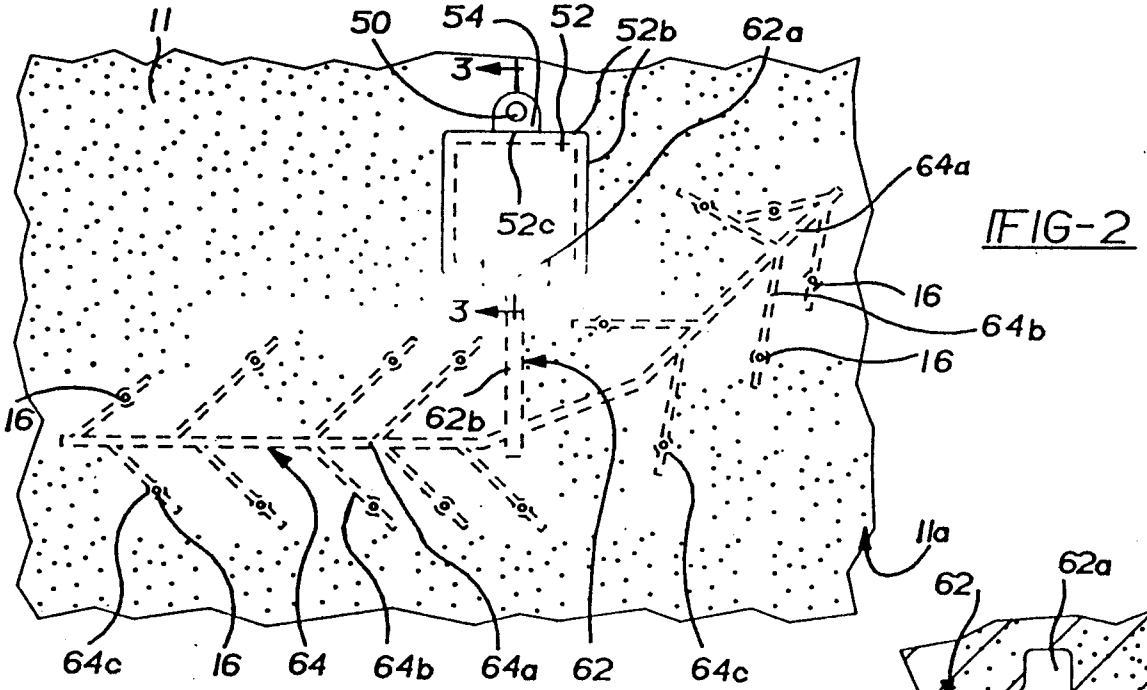
FIG. 2 is a plan view of the upper side of the drag slab along the line 2—2 of FIG. 1 with the runner and pin gate pattern formed in the underside of the mold drag superimposed in phantom lines over the upper side of the drag slab. For clarity, no alloyant is shown in the reaction chamber of the drag slab.
Figure 3:
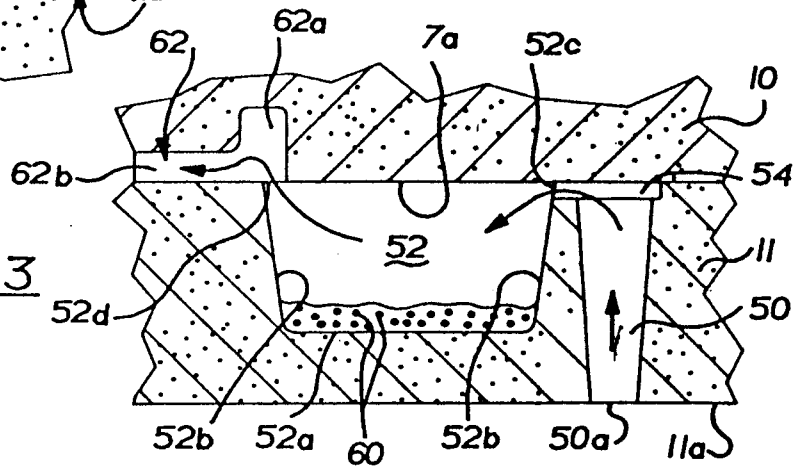
FIG. 3 is an enlarged fragmentary sectioned view taken along line 3—3 of FIG. 2.

Referring to FIGS. 1-3, in accordance with one embodiment of the invention, the drag slab 11 includes a single sprue 50 having a lower inlet 50*a* for engaging the pool 2 and supplying the melt 4 to a reaction chamber 52 when the lower side 11*a* of the drag slab 11 is immersed in the pool 2 with the mold cavity 14 evacuated. The sprue 50 extends between the lower side 11*a* and the upper side 11*b* of the drag slab 11 and is in flow communication with the reaction chamber 52 via a recessed inlet chamber 54 formed in the upper side 11*b* of the drag slab 11.

The reaction chamber 52 includes a horizontal bottom wall 52*a* and upstanding (slightly outwardly diverging) side walls 52*b*. The top of the reaction chamber 52 and the recessed inlet chamber 54 are closed off by the bottom side 7*a* of the casting mold 7 (i.e., by the bottom side of the mold drag 10) as best shown in FIG. 3.

As will be explained in more detail hereinbelow, an alloyant 60 in suitable form (e.g., alloy particulate) is disposed in the reaction chamber 52 to be so contacted by the melt 4 drawn upwardly through the sprue 50 and into the reaction chamber 52 during countergravity casting as to introduce a selected quantity of the alloyant 60 into the melt 4 immediately prior to its entering the mold cavity 14.

The alloyant 60 is positioned in the reaction chamber 52 of the drag slab 11 before the drag slab 11 is assembled with the casting mold 7. In particular, the appropriate quantity of the alloyant 60 is first placed in the reaction chamber 52 of the drag slab 11 and the casting mold 7 is then disposed atop the drag slab 11 as shown in FIG. 1. Although the mold 7 is described as including a single mold cavity 14, the invention envisions supplying the treated melt 4 from the reaction chamber 52 to a plurality of mold cavities 14 in one or more molds 7 disposed on the drag slab 11.

Referring to FIGS. 2-3, the reaction chamber 52 includes an inlet 52*c* at its juncture with the recessed inlet chamber 54 and an outlet 52*d* at its juncture with a primary, lateral (horizontal) runner 62 formed in the bottom side 7*a* of the mold 7. The runner 62 communicates in flow relation with a secondary lateral (horizontal) runner 64 also formed in the bottom side 7*a* of the mold 7. The secondary runner 64 in turn communicates in flow relation with each of the plurality of narrow upstanding ingates 16 (i.e., pin gates) formed in the lower mold portion 10 and extending between the mold cavity 14 and the bottom side 7*a*.

Referring to FIG. 3, the primary runner 62 includes a riser portion 62*a* proximate the outlet 52*d* of the reaction chamber 52. The riser portion 62*a* has an increased vertical dimension (compared to other portions 62*b* of the runner 62 remote from the reaction chamber outlet 52*d*) so as to trap dross inclusions and other floating debris in the treated melt 4 exiting the reaction chamber 52. The outlet 52*d* of the reaction chamber 52 communicates directly with the riser portion 62*a* formed in the bottom side 7*a* of the mold 7 to this end.

The secondary runner includes a main runner portion 64*a* and a plurality of branch runner portions 64*b* each communicating with a respective ingate 16. The ingates 16 (pin gates) preferably have a major dimension (e.g., diameter for the cylindrical ingates shown) not exceeding about 0.50 inch, preferably not exceeding about 0.25 inch (e.g., about 0.22 inch) for purposes set forth in U.S. Pat. No. 4,340,108 and hereinafter described. A particular pattern of the primary and secondary runners 62,64 formed in the bottom side 7*a* of the mold 7 is shown best in FIG. 2 wherein the pattern is superimposed in phantom lines atop the upper side 11*b* of the drag slab 11.

Referring to FIGS. 1-3, countergravity casting of the melt 4 into the casting mold assembly 6 is effected by relatively moving the mold assembly 6 and the pool 2 to immerse the underside 11*a* of the drag slab 11 in the melt 4. Typically, the casting mold assembly 6 is lowered toward the pool 2 using a hydraulic power cylinder 61 (shown schematically) actuating a movable support arm 63 (shown schematically) that is connected to the vacuum box 20. The vacuum chamber 22 is then evacuated to draw the melt 4 upwardly through the sprue 50 and through reaction chamber 52 where the melt 4 so contacts the alloyant 60 as to have the alloyant 60 introduced (e.g., dissolved) therein above a predetermined effective concentration. The treated melt 4 (i.e., the melt containing the alloyant) is drawn through the outlet 52*d* of the reaction chamber 52 through the runners 62,64 and the pin gates 16 into the mold cavity 14 to fill it with the treated melt 4.

After filling of each mold cavity 14 with the treated melt 4 and initial solidification of the treated melt in the pin gates 16, the vacuum box 22 is raised by hydraulic power cylinder 60 to withdraw the underside 11*a* of the drag slab 11 out of the pool 2. The number and size of the narrow pin gates 16 to achieve melt solidification initially at the pin gates 16 can be selected in accordance with the teachings of U.S. Pat. No. 4,340,108. Alternatively, the treated melt 4 can be allowed to solidify in both the pin gates 16 and the mold cavity 14 before raising the vacuum box 22 to withdraw the mold assembly 6 out of the pool 2. The vacuum box 22 and the melt-filled mold assembly 6 are then separated.

Those skilled in the art will appreciate that the size and shape of the sprue 50, reaction chamber 52 and inlet chamber 54 formed in the drag slab 11 are dependent upon the size and shape of the part to be cast as well as on the composition of the specific melt 4 and alloyant 60 employed. Moreover, the size and shape of the primary and secondary runners 62,64 and pin gates 16 formed in the mold drag 10 are similarly dependent. These features of the mold assembly 6 are selected to provide a desired melt flow rate and residence time in the reaction chamber 52 and melt flow rate into the mold cavity 12.

By way of illustration and not limitation, a casting mold 7 and drag slab 11 similar to those described hereinabove (i.e., having a similar sprue 50, reaction chamber 52, inlet chamber 54, runners 62,64 and pin gates 16) were used to countergravity cast an automobile engine manifold of nodular iron. The cast exhaust manifold weighed about 21 lbs. including the solidified metal in the reaction chamber 52, runners 62,64 and pin gates 16. The reaction chamber 52 included an upper square (about 4.47 inch×about 4.47 inch) cross-section tapering down (5°) to a depth of about 2.52 inches to provide a lower square (about 4.05 inch×about 4.05 inch) cross-section at the bottom wall 52*a*. The sprue 50 had a length of about 3.70 inches and a maximum diameter of about 1.40 inch at its outlet adjacent the recessed inlet chamber 54 and minimum diameter of about 0.79 inch at its inlet 50*a*. The recessed chamber 54 was about 0.30 inch in depth and about 1.62 inch in width where it intersected the reaction chamber 52 to provide a reaction chamber inlet area of about 0.49 square inches. The longitudinal axis of the sprue 50 was offset from the reaction chamber inlet 52*c* by about 1.25 inch.

The primary and secondary runners 62,64 were formed in the bottom side 7*a* of the casting mold 7 in a pattern similar to that illustrated in FIG. 2. The primary runner 62 had an overall length of about 5.12 inches. The riser portion 62*a* of the primary runner 62 was rectangular in cross-section (about 1.68 inch major width×about 0.413 minor width×about 1.00 inch height) and intersected the reaction chamber 52 to provide a reaction chamber outlet area of about 0.42 square inches. The area of the reaction chamber outlet 52*d* was selected to maintain the reaction chamber 52 metallostatically pressurized and filled with the melt 4 during the entire casting process (i.e., until the mold cavity 14 was filled with the melt 4).

The smaller portions 62*b* of the primary runner 62 had a square cross-section (about 0.413 inch×about 0.413 inch).

The main portion 64*a* of the secondary runners 64 had a square cross-section (about 0.413 inch×about 0.413 inch) and an overall length of about 25.62 inches (the left hand segment in FIG. 2 being about 14.50 inches in length and the right hand segment being about 11.12 inches in length). The smaller branch portions 64*b* of the secondary runners 64 each had a generally square cross-section (about 0.220 inch×about 0.220 inch). The branch portions 64*b* were formed with cylindrical wells 64*c* (about 0.375 inch diameter) in communication with each cylindrical pin gate 16 (0.220 inch diameter) formed in the mold drag 10. A total of fifteen pin gates 16 were used to supply treated molten iron to the manifold-shaped mold cavity 14. Molten metal filter (not shown) may be used in the runner system 62,64.

Prior to assembly of the casting mold 7 and the drag slab 11, about 120 grams (0.264 lbs.) of an inoculant alloy 60 in particulate form (e.g., 5×18 mesh) was positioned in the reaction chamber 52 to a depth of about 0.25 inches. The inoculant alloy 60 has a nominal composition in weight percent (w/o) of 4.06 w/o Mg, 46.04 w/o Si, 1.14 w/o total rare earths, 0.48 w/o Ca, 0.71 w/o Al, balance Fe and is available under the trademark INMOLD II inoculant alloy owned by Material & Methods Limited, Surrey, England.

A gray iron melt 4 devoid of any carbon nodularizing agent was maintained at about 2640° F. in the underlying casting vessel 3. The melt 4 was drawn upwardly from the vessel 3 by establishing a suitable vacuum in the vacuum chamber 22 (e.g., about 140 inches of water) when the lower side 11*a* of the drag slab 11 was immersed in the melt 4. The iron melt 4 was drawn upwardly through the sprue 50 and passed through the reaction chamber 52 where it reacted (dissolved) the INMOLD II inoculant alloy 60. The treated iron melt 4 was supplied to the mold cavity 14 via the runners 62,64 and the pin gates 16. The solidified exhaust manifold casting was sectioned, examined and found to contain nodularizied carbon (graphite) throughout the casting.

Although the illustrative embodiment of the invention is described hereinabove with respect to the introduction of a nodularizing agent to an iron melt 4 to spherodize the carbon therein, those skilled in the art will appreciate that the invention is not so limited. For example, alloyants such as copper, chromium, manganese, molybdenum, silicon as well as others that are soluble in the melt 4 may be introduced into the melt 4 during countergravity casting in accordance with the invention.

By way of further illustration and not limitation, the alloyant 60 in the reaction chamber 52 may comprise copper in particulate or other form. A ferritic nodular iron melt 4 (corresponding in composition to the known ferritic nodular iron grade 4010) is drawn upwardly from the casting vessel 3 through the sprue 50, through the reaction chamber 52 and then into the mold cavity 14 in the manner as described hereinabove. The copper is introduced (i.e., dissolved) into the melt 4 as it passes through the reaction chamber 52 in a sufficient amount (e.g., about 0.4 w/o minimum to about 0.5 w/o maximum) to impart a microstructure and mechanical properties to the resultant casting corresponding to the known pearlitic nodular iron grade 5203.

The present invention thus envisions producing castings having different compositions/microstructures and resultant mechanical properties from a common underlying melt 4 by successively countergravity casting a plurality of mold assemblies 6 having different alloyants 60 in their reaction chambers 52 from the common pool 2. A "universal" cupola melt thus can be used to supply the common pool 2. The need to prepare and handle different base melts in one or more melting vessels/ladles is thereby eliminated. Moreover, the flexibility of the vacuum countergravity casting process in meeting ever changing production schedule variations is tremendously improved.

Furthermore, those skilled in the art will recognize that the invention is not limited to the casting of cast irons and may also be used in the differential pressure, countergravity casting of other metal/alloys where selective introduction of one or more alloyants is desired for some purpose. For example, the present invention may be used to introduce (dissolve) known degassing, desulfurizing, deslagging and similar treating agents into aluminum and steel during the vacuum countergravity casting thereof.

While the invention has been described in terms of specific embodiments thereof, it is not intended to be limited thereto but rather only to the extent set forth hereafter in the claims which follow.

I claim:

1. Apparatus for the differential pressure, countergravity casting of molten metal, comprising:

(a) a drag slab having an upper side, a lower side having an inlet adapted for engaging an underlying source of molten metal, a reaction chamber between said upper side and said lower side and communicating with said inlet for introducing an alloyant therein into the molten metal flowing through the reaction chamber, (b) a casting mold disposed on the upper side of the drag slab, said casting mold including a bottom side engaging the upper side of the drag slab, a mold cavity therein and a mold ingate passage between said mold cavity and said bottom side and in molten metal flow communication with the reaction chamber for receiving the molten metal therefrom, (c) means for relatively moving the drag slab and source of molten metal to engage the inlet with the underlying molten metal, and (d) means for establishing a sufficient differential pressure between said mold cavity and said source when said inlet and said source are engaged as to draw the molten metal upwardly through said inlet into the reaction chamber where the molten metal so contacts the alloyant as to introduce said alloyant therein and then through the mold ingate passage for filling the mold cavity with the molten metal containing said alloyant therein.

2. The apparatus of claim 1 wherein the lower side of the drag slab is adapted for immersion in said source so as to engage said inlet and said source.

3. The apparatus of claim 1 wherein the alloyant comprises a fugitive alloyant.

4. The apparatus of claim 1 further including a runner so disposed between the upper side of the drag slab and the bottom side of the casting mold as to place the reaction chamber and the mold ingate passage in molten metal flow communication.

5. The apparatus of claim 4 wherein said mold ingate passage comprises a pin gate having a major lateral dimension not exceeding about 0.25 inch.

6. The apparatus of claim 4 wherein a portion of the runner proximate the reaction chamber is disposed above a portion of the runner remote from the reaction chamber so that dross, inclusions and other debris that float in the molten metal are trapped in the portion of the runner proximate the reaction chamber.

7. The apparatus of claim 4 wherein the runner is formed in the bottom side of the casting mold.

8. The apparatus of claim 7 wherein the casting mold comprises a gas permeable mold cope disposed on a mold drag having said bottom side, said runner being formed in said bottom side of the mold drag.

9. The apparatus of claim 8 wherein said mold drag includes said mold ingate passage comprising a pin gate having a major lateral dimension not exceeding about 0.25 inch.

10. The apparatus of claim 1 wherein the means for establishing the differential pressure comprises a vacuum chamber confronting a gas permeable portion of the casting mold to evacuate the mold cavity.

11. Apparatus for the differential pressure, countergravity casting of nodular iron, comprising:

(a) a drag slab having an upper side, a lower side having an inlet adapted for engaging an underlying source of molten iron, a reaction chamber between said upper side and said lower side and communicating with the inlet, and a carbon nodularizing agent in the reaction chamber, (b) a casting mold disposed on the upper side of the drag slab, said mold including a bottom side engaging the upper side of the drag slab, a mold cavity therein and a mold ingate passage between said mold cavity and said bottom side, (c) a molten metal runner so disposed between the upper side of the drag slab and the bottom side of the mold as to communicate the reaction chamber and the mold ingate passage, (d) means for relatively moving the drag slab and the pool of molten metal to engage the inlet and the underlying molten iron, and (e) means for establishing a sufficient differential pressure between said mold cavity and said source when said inlet and said source are engaged as to draw the molten iron upwardly through said inlet into the reaction chamber for nodularization by the carbon nodularizing agent and then through the runner into the mold ingate passage for filling the mold cavity with the nodularized molten iron.

12. The apparatus of claim 11 wherein the lower side of the drag slab is adapted for immersion in said source so as to engage said inlet and said source.

13. The apparatus of claim 11 wherein said mold ingate passage comprises a pin gate having a major lateral dimension not exceeding about 0.25 inch.

14. A method of differential pressure, countergravity casting of molten metal, comprising:

(a) disposing a casting mold on a drag slab having a reaction chamber, a fugitive alloyant in the reaction chamber and an inlet communicating the reaction chamber and a lower portion of the drag slab adapted for engaging an underlying source of molten metal, said casting mold having a mold cavity and a mold cavity ingate passage in molten metal flow communication with the reaction chamber, (b) engaging the inlet of the drag slab with the underlying molten metal, and (c) establishing a sufficient differential pressure between said mold cavity and said source when said inlet and said source are engaged to draw the molten metal upwardly through the inlet into the reaction chamber where said molten metal so contacts the fugitive alloyant as to introduce said alloyant therein and then through the mold ingate passage to fill the mold cavity with the molten metal containing said alloyant therein.

15. A method of differential pressure, countergravity casting of nodular iron, comprising:

(a) disposing a casting mold on a drag slab having a reaction chamber, a carbon nodularizing agent in the reaction chamber and an inlet communicating the reaction chamber and a lower portion of the drag slab adapted for immersion in an underlying pool of molten iron, said casting mold having a mold cavity and a mold cavity ingate passage in molten metal flow communication with the reaction chamber, (b) immersing the inlet of the drag slab in the pool of molten iron, and (c) establishing a sufficient differential pressure between said mold cavity and said pool when the inlet of the drag slab is immersed in the pool to draw the molten iron upwardly through the inlet into the reaction chamber where said molten iron is nodularized by the carbon nodularizing agent and then through the mold ingate passage to fill the mold cavity with the nodularized molten iron.

* * * * *

UNITED STATES PATENT AND TRADEMARK OFFICE

CERTIFICATE OF CORRECTION

PATENT NO. : 5,038,846

DATED : August 13, 1991

INVENTOR(S) : Herbert W. Doty

It is certified that error appears in the above-identified patent and that said Letters Patent is hereby corrected as shown below:

IN THE ABSTRACT:

Line 5 delete "rubber" and insert --runner-- therefor.

Column 8, line 4, delete "nodularizied" and insert --nodularized-- therefor.

Signed and Sealed this

Tenth Day of August, 1993

*Attest:*

Michael K. Kirk

MICHAEL K. KIRK

*Attesting Officer*

*Acting Commissioner of Patents and Trademarks*